US010138854B2

(12) United States Patent
Schultz

(10) Patent No.: US 10,138,854 B2
(45) Date of Patent: Nov. 27, 2018

(54) FUEL RAIL AND METHOD OF MAKING A FUEL RAIL

(71) Applicant: Benteler Automobiltechnik GmbH, Paderborn (DE)

(72) Inventor: Jonas Schultz, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 15/365,349

(22) Filed: Nov. 30, 2016

(65) Prior Publication Data

US 2017/0159627 A1 Jun. 8, 2017

(30) Foreign Application Priority Data

Dec. 2, 2015 (DE) ..... 10 2015 120 962

(51) Int. Cl.
*F02M 63/02* (2006.01)
*F02M 55/02* (2006.01)
*F02M 69/46* (2006.01)

(52) U.S. Cl.
CPC ..... *F02M 55/025* (2013.01); *F02M 63/0225* (2013.01); *F02M 69/465* (2013.01);
(Continued)

(58) Field of Classification Search
CPC .. F02M 55/025; F02M 55/04; F02M 63/0225; F02M 63/0275; F02M 2200/80;
(Continued)

(56) References Cited

U.S. PATENT DOCUMENTS 3,948,226 A * 4/1976 Green ..... F01C 9/00 123/18 R
4,209,209 A * 6/1980 Stark ..... F16C 9/02 123/195 S (Continued)

FOREIGN PATENT DOCUMENTS

CN 101943096 A 1/2011
CN 201778935 U 3/2011

(Continued)

OTHER PUBLICATIONS

Chinese Search Report dated Jul. 23, 2018 with respect to counterpart Chinese patent application 2016111002137.

(Continued)

*Primary Examiner* — Lindsay Low
*Assistant Examiner* — George Jin
(74) *Attorney, Agent, or Firm* — Henry M. Feiereisen LLC

(57) ABSTRACT

A forged fuel rail for a motor vehicle includes a tubular base body, an inlet formed in one piece on the base body and made of a same material as the base body. Further formed in one piece on the base body and made of a same material as the base body are a plurality of injector mounts and, a support element for securement of the fuel rail to a further motor vehicle component. A reinforcement member extends between a corresponding one of the injector mounts and the support element and is formed in one piece on the base body and made of a same material as the base body. The reinforcement member is hereby formed from a flash created during a forging process.

11 Claims, 7 Drawing Sheets

(52) U.S. Cl.
CPC . *F02M 2200/80* (2013.01); *F02M 2200/8053* (2013.01); *F02M 2200/857* (2013.01)

(58) Field of Classification Search
CPC ..... F02M 2200/8053; F02M 2200/803; F02M 2200/856; F02M 2200/857; F02M 69/465; F02M 61/14; F02M 61/16
See application file for complete search history.

(56) References Cited

U.S. PATENT DOCUMENTS 4,810,465 A * 3/1989 Kimura ..... C22C 14/00 420/417
6,536,397 B2 * 3/2003 Mizutani ..... B23K 20/129 123/188.8
9,810,189 B2 * 11/2017 Maier ..... F02M 69/50
2008/0178457 A1 * 7/2008 Nagasaka ..... B21D 39/06 29/525
2012/0138020 A1 * 6/2012 Kweon ..... F02M 55/025 123/469
2014/0305411 A1 * 10/2014 Ikoma ..... F02M 55/025 123/470

FOREIGN PATENT DOCUMENTS

CN 201908761 U 7/2011
CN 202082024 U 12/2011
DE 39 32 672 4/1990
DE 295 21 402 6/1997
DE 10 2010 051 004 5/2012

OTHER PUBLICATIONS

Translation of Chinese Search Report dated Jul. 23, 2018 with respect to counterpart Chinese patent application 2016111002137.

* cited by examiner

FUEL RAIL AND METHOD OF MAKING A FUEL RAIL

CROSS-REFERENCES TO RELATED APPLICATIONS

This application claims the priority of German Patent Application, Serial No. 10 2015 120 962.4, filed Dec. 2, 2015, pursuant to 35 U.S.C. 119(a)-(d), the disclosure of which is incorporated herein by reference in its entirety as if fully set forth herein.

BACKGROUND OF THE INVENTION

The present invention relates to a fuel rail and to a method of making a fuel rail.

The following discussion of related art is provided to assist the reader in understanding the advantages of the invention, and is not to be construed as an admission that this related art is prior art to this invention.

A fuel rail is a component of the fuel supply of a motor vehicle. Fuel is injected at high pressure into a base body of the fuel rail and transferred via fuel injectors into the cylinders. The fuel rail is hereby exposed to very high pressures. One approach to address this problem involves the production of the fuel rail as forged part and using subsequent machining processes to produce a tubular base body as well as fuel inlet and injector mounts. Support elements are further provided to fasten the fuel rail to further motor vehicle parts. During operation, fuel under pressure is discharged from the base body through the fuel injectors. The injector mounts are hereby moved by the work done by the fuel injectors, while the portions of the fuel rail that are connected via the support elements with the motor vehicle remain stationary. A force is thus introduced into the fuel rail in the region of an injector mount during operation of the vehicle. While this force is dissipated via the support elements that normally are fastened to a cylinder head, the movement of the injector mounts causes deformation of the fuel rail. This poses another problem because the deformation causes seals, such as O rings, disposed between the fuel injector and the injector mount to become leaky very quickly by the continuous motion or wear off so that there is a risk of unwanted fuel egress that in a worst case scenario may ignite. Such O rings which are made of a rubber or caoutchouc material are therefore prone to leak or wear off as a result of the movement by the injector mounts and deformation of the fuel rail. Thus, tightness of the fuel is absolutely necessary to maintain for safety reasons.

While suggestions have been made to address this problem by stiffening the fuel rail through increase of the wall thickness of the fuel rail. This, however, increases also weight of the fuel rail which goes against the desire for a lightweight construction and weight savings demanded in the automobile industry.

It would therefore be desirable and advantageous to provide an improved fuel rail which obviates prior art shortcomings and which is of lightweight construction and yet is subject to minimal deformation during operation.

SUMMARY OF THE INVENTION

According to one aspect of the present invention, a forged fuel rail for a motor vehicle includes a tubular base body, an inlet formed in one piece on the base body and made of a same material as the base body, a plurality of injector mounts formed in one piece on the base body and made of a same material as the base body, a support element formed in one piece on the base body for securement to a further motor vehicle component, and a reinforcement member extending between a corresponding one of the injector mounts and the support element and formed in one piece on the base body and made of a same material as the base body.

The present invention resolves prior art problems by stiffening the fuel rail so as to minimize deformation through formation of a reinforcement member which is made in one piece with the base body and of same material as the base body and which extends between an injector mount and a support element. The provision of the reinforcement member minimizes the load path between the force entry point in the injection mount and the force exit point in the support element. This results in a stiffening effect that opposes a deformation of the fuel rail.

A forging process affords the benefit of allowing production of a fuel rail according to the present invention in one piece and of same material. There is no need for soldered or welded seams or similar joints between individual components that represent potential weak spots. Moreover, the number of work steps to assemble the fuel rail is decreased, thereby simplifying the overall production process. The forging process is further capable of realizing complex component geometries. Basically, any forging process is feasible. Currently preferred is, however, a drop forging process.

An example of an appropriate material includes austenitic steel, such as a stainless steel alloy. Examples of steels include steels of the type 1.4307 or 1.4301. However, any material is suitable that is fuel resistant so as to avoid corrosive damage to the material. Also the use of coated steel may find application so long as it is also sufficiently fuel resistant.

The base body of the fuel rail receives fuel under great pressure. The term "tubular base body" is to be understood in the description as any elongate hollow body regardless of its shape, i.e. the interior space or outer periphery of the basic body do not necessarily require to have a round or circular cross section. Still, the provision of a round cross section of the interior space is currently preferred because the interior space can be formed by a blind bore or other machining process after the forging process that results anyway in a round cross section.

The injector mounts are provided to connect fuel injectors which inject fuel into the cylinder head. The provision of a support element enables a securement of the fuel rail to a further motor vehicle component and support of the fuel rail.

The position of the inlet depends substantially on the constructive situation at hand. The inlet may be located on an end face and on a sidewall of the base body. When the inlet is located at an end face, it is necessary to close the open end of the base body, produced by the bore, with a plug. In addition, it is possible to provide a further mount at one end of the base body or on an end face thereof in one piece with the base body and advantageously of same material. A pressure sensor for example may be placed in the mount for controlling the internal pressure in the fuel rail.

According to another advantageous feature of the present invention, the corresponding one of the injector mounts and the support element can be positioned adjacent to one another, with the reinforcement member extending there between. As described above, the load path should be conducted over a shortest possible connection between entry and exit points. This can be realized by forming the reinforcement member to extend from the injector mount as force entry point directly to the support member as force exit point. In this way, the shortest possible guidance of the load path is realized, without the need for additional stiffening structures that only increase weight.

According to another advantageous feature of the present invention, the injector mount and the support element can extend in parallel orientation. The term "parallel orientation" relates hereby to an orientation of the center longitudinal axis of the injector mount and the support element in perpendicular relation to the longitudinal axis of the base body in the same plane. This configuration has the benefit that an injector can be arranged in the corresponding injector mount in an optimal manner and the fuel rail as a whole is easy to install. Also, the forging process is simplified by this simple geometric configuration as the injector mount and the support element can be arranged in a parting plane of the forging tool.

The reinforcement member is normally connected with the injector mount, support element, and, optionally, the base body. Any edge of the reinforcement member that is adjacent to a part of the fuel rail is designated in the description as "connected edge". Conversely, any edge of the reinforcement member that is not adjacent to any component of the fuel rail is designated as "free edge".

According to another advantageous feature of the present invention, the reinforcement member can have a free first edge shaped to be at a minimum in relation to an extension of the reinforcement member perpendicular to a longitudinal axis of the base body and distanced to the corresponding one of the injector mounts and the support element. A steady minimum may be involved here, which means that the free edge defines an even continuous curve. Of course, an unsteady minimum may be involved as well, which means that the free edge has at least one area which is defined by an uneven, discontinuous curve. For example, the reinforcement member may include in this area a triangular recess or the free edge can be comprised of several linear segments. It is also possible, that no locally punctiform minimum is involved but the minimum is configured flat so that the reinforcement member has in a particular region a constant extent in perpendicular relation to the longitudinal axis of the base body.

According to another advantageous feature of the present invention, the free edge of the reinforcement member can extend in a continuous curve defined by a radius of, advantageously, 5 to 10 millimeter. Currently preferred is a radius of about 7 to 8 millimeters. The objective is again to establish a smallest possible load path by the course of the free edge and to realize a smoothest possible transition between the reinforcement member and the adjacent fuel rail component, i.e. injector mount or support element.

According to another advantageous feature of the present invention, the reinforcement member can have a second edge which is connected to the support element and defines with the free first edge of the reinforcement member a first angle, with the reinforcement having a third edge which is connected to the corresponding one of the injector mounts and defines with the free first edge of the reinforcement member a second angle, each of the first and second angles being less than 90° or advantageously less than 60°. Currently preferred are first and second angles of less then 45°. Such a smooth transition between the reinforcement member and the adjacent fuel rail component minimizes stress especially at connections between the reinforcement member and the fuel rail component. The reinforcement member can be linearly connected along a connected edge with an injector mount or support element or base body. This means that the connection area between the reinforcement member and the fuel rail component extends linearly elongate and narrow.

According to another advantageous feature of the present invention, the free first edge can be shaped to enable a shortest possible load path through the reinforcement member between an entry point of a force at the corresponding one of the injector mounts and an exit point of the force at the support element connected to the corresponding one of the injector mounts by the reinforcement member. Such a configuration of the reinforcement member results in a minimization of the load path so that stress can be kept to a minimum. The actual geometric configuration of the reinforcement member can be determined as a function of the situation at hand. By appropriately configuring the reinforcement member, the load path can be minimized and weight can be optimized because unnecessary material for the reinforcement element can be avoided.

According to another advantageous feature of the present invention, the reinforcement member can have a mean thickness of 2 to 5 millimeters, advantageously 2.5 to 4.5 millimeters. Currently preferred is a mean thickness of 4 millimeters. The concrete determination of the mean thickness of the reinforcement member is, however, dependent on the situation at hand. Geometric conditions of the individual fuel rail components play hereby a role, as do the available installation space or known load paths. Thus, there is another possibility to optimize the behavior of the fuel rail. The term "mean" relates hereby to the average value of the thickness over the entire extent of the reinforcement member in perpendicular relation to the longitudinal axis of the base body.

According to another advantageous feature of the present invention, the reinforcement member may have a variable thickness over its extent between the fuel rail components. This results in an additional adjustment option for suiting the geometry of the component to the indentified load paths and also in a weight optimization.

Advantageously, the reinforcement member can have along the connected edges thereof in a region immediately adjacent to the fuel rail components a greater thickness than in the remaining regions. The reinforcement member can have in the area following the fuel rail components a first thickness which transitions gradually into a second thickness which corresponds to the desired thickness of the reinforcement member.

According to another advantageous feature of the present invention, the reinforcement member can be formed from a flash formed during a forging process. In certain forging processes, e.g. drop forging, a flash is formed in the partition plane of the forging tool. This normally is removed, thus requiring an additional work step, once the forging process is concluded. The formed flash is therefore considered waste. In accordance with the present invention, this formed flash is now being used for making the reinforcement member so that waste can be significantly reduced. Moreover, it is not necessary to produce the reinforcement member in the tool itself so that the configuration of the tool or tool form can be simplified. Following the forging process, the flash is machined. This involves hot trimming or cold trimming before, after or during finishing of the fuel rail.

Advantageously, provision may be made for the inlet to be formed at a sidewall of the base body. According to another advantageous feature of the present invention, the inlet can have a longitudinal axis extending in relation to a contact area of the support element at an angle of 50° to 80°, advantageously 65° to 75°. Currently preferred is an angle of 70° to 73°.

Provision may further be made to form a mount at a sidewall of the base body. This mount can be formed in one piece with the base body and made of same material. A pressure sensor for example may be placed in such a mount for controlling the internal pressure of the fuel rail. Also in this context, the benefits of the present invention become again readily apparent, since there is no need to join the mount separately in a further work step.

Advantageously, the mount defines a longitudinal axis which extends in relation to a contact area of the support element at an angle of 70° to 90°, advantageously 75° to 85°. Currently preferred is an angle of 79° to 81°.

According to another aspect of the present invention, a method of making a fuel rail for a motor vehicle includes shaping a blank in a forging tool through a forging process into a semi-finished product, thereby forming a flash, removing the semi-finished product from the forging tool, subjecting the semi-finished to a machining process, and trimming the flash such as to shape a reinforcement member.

As already described above, the application of a forging process has the benefit that the fuel rail as a whole can be made in one piece and of same material. There is no need to join together individual parts via several operating steps such as bonding, soldering, welding, or other joining processes as material joint.

In accordance with the method according to the present invention, a blank of metallic material, e.g. austenitic steel, can be used. Currently preferred is the use of stainless steel, e.g. of the type 1.4307 or 1.4301, is used a starting material. Prerequisite for the use of the material is in particular that the material is fuel-resistant to avoid corrosive damage to the material. Instead of stainless steel, it is, of course, also possible to use a suitably coated steel.

Such a blank, which may involve a metal block or also shaft or rod, is placed in the forging tool, e.g. a drop forging tool. During drop forging, the blank is shaped in one or more steps into a semi-finished product, with a flash being formed on the blank. After being removed from the forging tool, the semi-finished product undergoes a machining process, which involves a material removing process such as drilling, cutting, trimming, and the like. In particular, drilling is applied to form the interior space of the base body and the inlets and injector mounts. The drilling process for the interior space may result in a blind hole or continuous bore. When producing a blind hole, the inlet of the borehole can be used as inlet for fuel or is closed by a plug. The same applies for a continuous bore so that one borehole end can be used as inlet for fuel and the other borehole end can be closed by a plug, or both borehole ends can be closed by plugs, respectively.

The machining process also includes a trimming of the flash in such a way as to shape a reinforcement member.

According to another advantageous feature of the present invention, the forging tool can be a split forging tool, with the flash being formed in a parting plane of the split forging tool. By using the formation of the flash for making a reinforcement member, several benefits are obtained. The drop forging process with flash formation can be implemented by using relatively simple tools. In contrast thereto, when, for example, a drop forging process is involved without flash formation, there is a need to seal the tool. Moreover, drop forging with flash formation allows easy drainage of excess material whereas in drop forging without flash formation, a precise material amount has to be measured. While conventionally the formation of a flash is considered waste that has to be removed, the present invention addresses this problem of waste by using the flash to make the reinforcement member. Waste is minimized, while at the same time the forging tool can be designed simpler and the overall process becomes more cost-effective.

The configuration of the tool cavity for the flash further renders possible to also determine the geometry of the reinforcement member in terms of thickness of the reinforcement member so that a further design option of the geometry is provided.

Advantageously, a plurality of injector mounts and at least one support element for securement of a further fuel rail part can be formed and the flash can be trimmed in such a way that a reinforcement member is formed between a corresponding one of the injector mounts and the support element. Of course, formation of a reinforcement member between injector mounts is also conceivable. In this way, weight and range of application is further optimized. The reinforcement member is formed only at those locations that provide maximum value. At the same time, only material is used that is actually needed so that the weight of the fuel rail is also optimized.

Another benefit involves the possibility that the blank can be shaped into a semi-finished product by a forging process that includes pre-forging and finishing forging. This multi-stage proceedings during production of the semi-finished product enables optimum formation of the geometry to attain a high process reliability.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
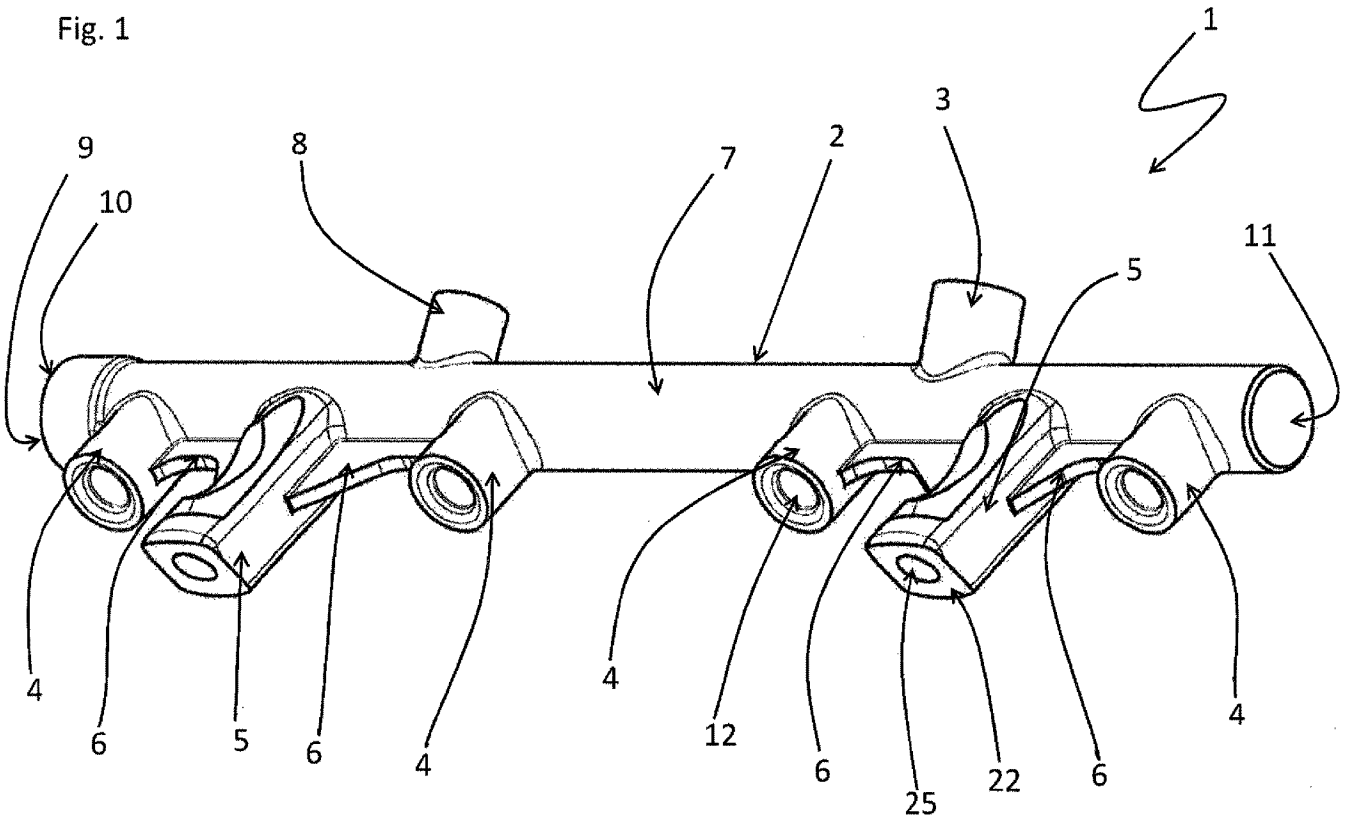
FIG. 1 is a perspective illustration of a fuel rail according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective illustration of a fuel rail according to the present invention, generally designated by reference numeral 1 and made through a forging process. The fuel rail 1 includes a tubular base body 2, an inlet 3 formed in one piece with a sidewall 7 of the base body 2 and made of same material, a plurality of injector mounts 4, formed in one piece with the base body 2 and made of same material, and support elements 5, formed in one piece with the base body 2 and made of same material. The fuel rail 1 is secured via the support elements 5 to a further motor vehicle component. Extending between adjacent injector mounts 4 and support elements 5 are reinforcement members 6, respectively, which are also formed in one piece with the base body 2 and made of same material as the base body 2. Provision is further made for a mount 8 for receiving a pressure sensor for determining an internal pressure.

The support elements 5 are typically secured to the cylinder head (not shown) via a screw connection. For that purpose, the support elements 5 have screw holes 25 which are produced by a machining process. When installed, the support element 5 contacts the cylinder head with its contact plane 22, with bolts being placed perpendicular to the contact plane 22 through the screw holes 25 and into corresponding threads in the cylinder head. The contact plane 22 may also be suited to the surface of the cylinder head in order to attain a full surface-to-surface contact.

When installed in a motor vehicle, the fuel injectors, which feed fuel into the cylinder head, are arranged in bores 12 of the injector mounts 4. During operation, fuel under pressure is injected via the injectors into the cylinder head. The resultant counterforce moves the injectors in a direction of the fuel rail 1. As a result of this movement of the injectors, a force is transmitted from the injector mounts 4 into the fuel rail 1. This causes a deflection of the injector mounts 4 out of their position at rest, while the support elements 5, which are firmly secured to the cylinder head, remain stationary. This causes deformation of the fuel rail 1 as a whole. The presence of the reinforcement members 6 counters this deformation to a minimum and ensures a lasting, error-free and fuel-tight operation of the fuel rail 1 by keeping any deflection of the injector mounts 4 to an admissible value below 1/10 of a millimeter. The reinforcement members 6 thus provide an effective stiffening of the fuel rail 1.

As shown in FIG. 1, the reinforcement members 6 respectively extend between an injector mount 4 and an adjacent support element 5. Of course, it is within the scope of the present invention, to provide a reinforcement member 6 also between adjacent injector mounts 4 to provide added stiffening, if need be.

Figure 2:
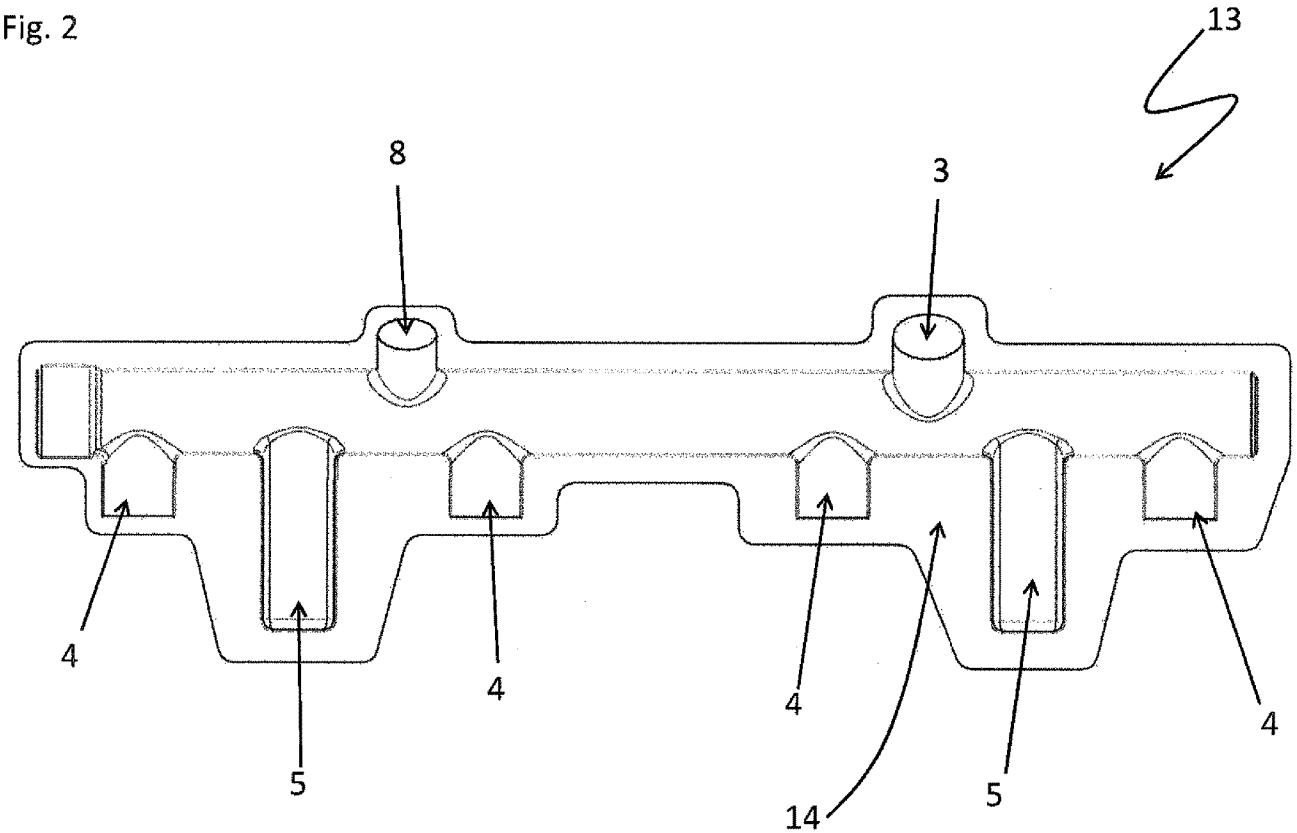
FIG. 2 is a plan view of a semi-finished product before undergoing a machining process.

The fuel rail 1 according to the present invention is produced by initially placing a blank in a forging tool. Depending on the complexity of the finished structure, the blank is shaped in one or more manufacturing steps into a semi-finished product 13, as shown by way of a plan view in FIG. 2. Inlet 3, mount 8, injector mounts 4, and support elements 5 are hereby formed in one piece with and of same material as the base body 2. While the blank is forged into the semi-finished 13, a flash 14 is formed in one piece and of same material.

When being removed from the forging tool, the semi-finished product 13 undergoes a machining process, e.g., to produce a blind bore that results in an interior space 23 (FIGS. 5, 6) of the base body 2. A first end face 9 of the base body 2 remains hereby intact, whereas the opposite second end face 11 is pierced and closed by a plug 10, after the interior space 23 has been created. Also the bores 12 for the injector mounts 4, the inlet 3, the mount 8 for a pressure sensor, and the screw holes 25 are produced. It is to be understood that the term "machining process" includes any material removal process as well as cutting, beveling, or trimming.

Figure 5:
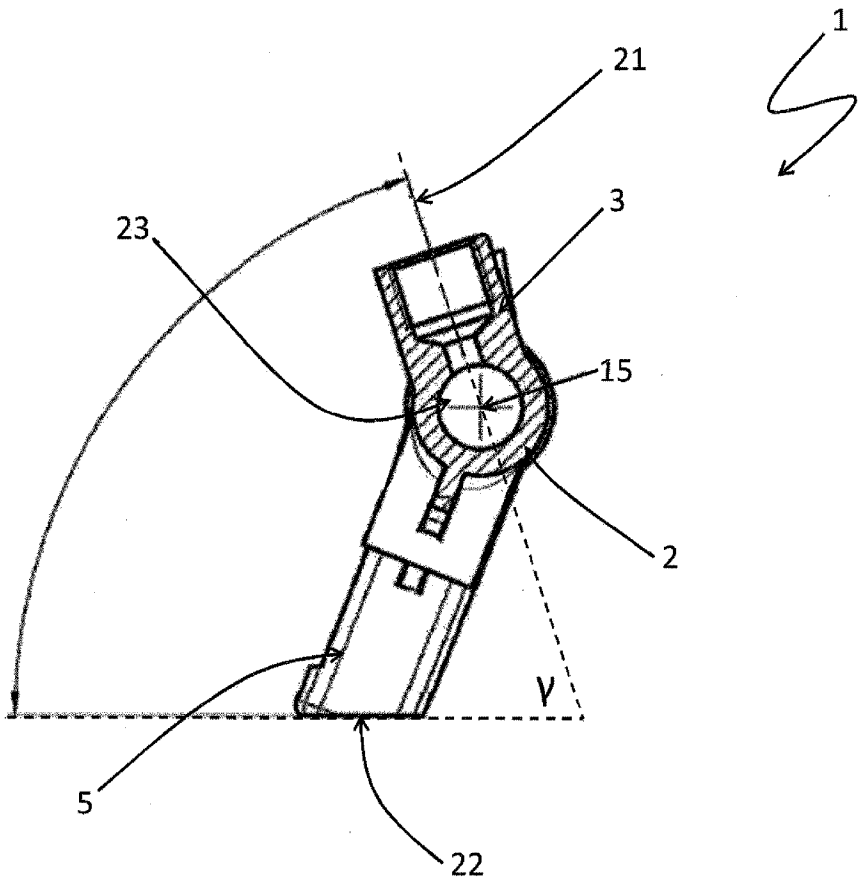
FIG. 5 is a sectional view of a base body in a region of an inlet.
Figure 6:
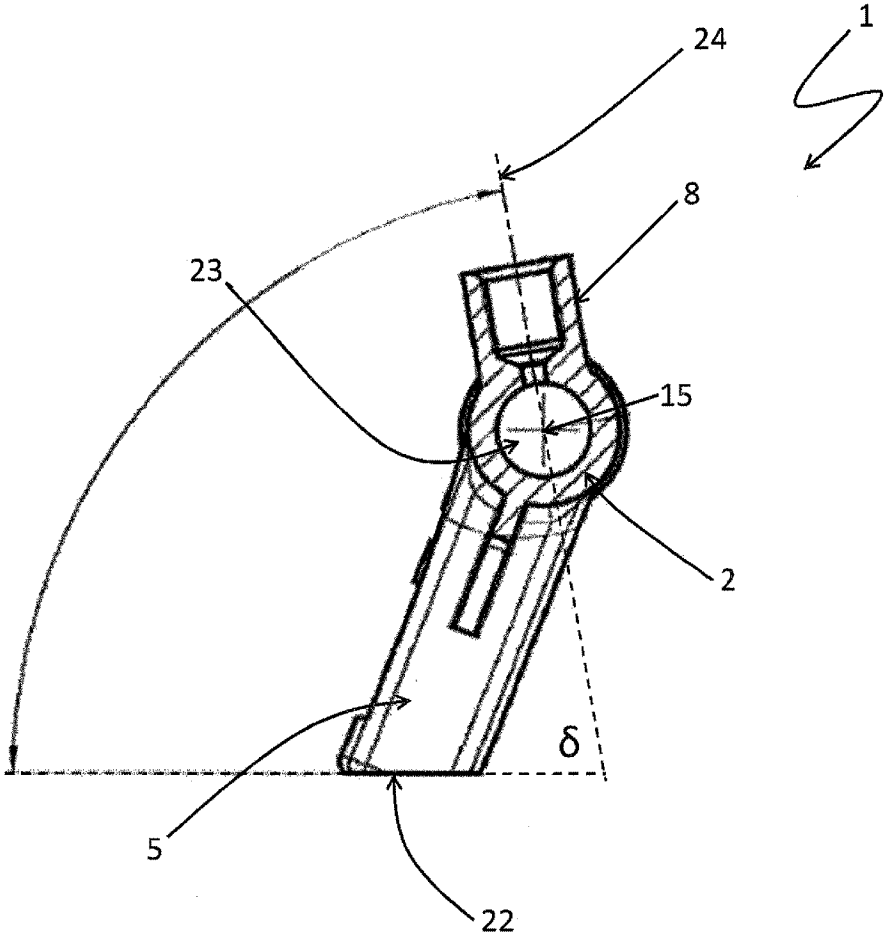
FIG. 6 is a sectional view of a base body in a region of a mount.

As is readily apparent from the sectional views of FIGS. 5 and 6, the interior space 23 has a round cross section. This is beneficial in terms of the resistance force against the internal pressure. The cross section remains also constant over the entire length of the base body 2. Of course, a different machining process may be applied in order to shape the semi-finished product 12 with other cross sections. For example, wall thicknesses are conceivable in at least some areas to suit stress, caused by the internal pressure or external force impacts. In such situations, the cross section of the interior space 23 and thus the diameter of the round cross section may vary along the longitudinal axis 15 of the base body 2. Also conceivable is a non-round cross section.

Locally adapted wall thicknesses may also be produced by varying the outer periphery perpendicular to the longitudinal axis 15 of the base body 2 over its length. Then, the cross section of the interior space remains constant.

The flash 14 is trimmed to shape the reinforcement members 6. In a forging process with various tool parts, the flash 14 is formed, which to date has been considered waste, but its presence simplifies the forging process. An example involves drop forging with flash formation. The formation of the flash 14 simplifies the forging process and the forging tools since excess material can easily flow off so that there is no need for a particular sealing of the tool. As mentioned above, the produced flash 14 has been removed to date. This is ineffective and produces waste. This problem is now addressed by the configuration of the fuel rail 1 according to the present invention. The amount of waste of forging material is reduced, thereby saving costs. The forging tool is still simple to design, further reducing costs, and simplifies handling.

Figure 3:
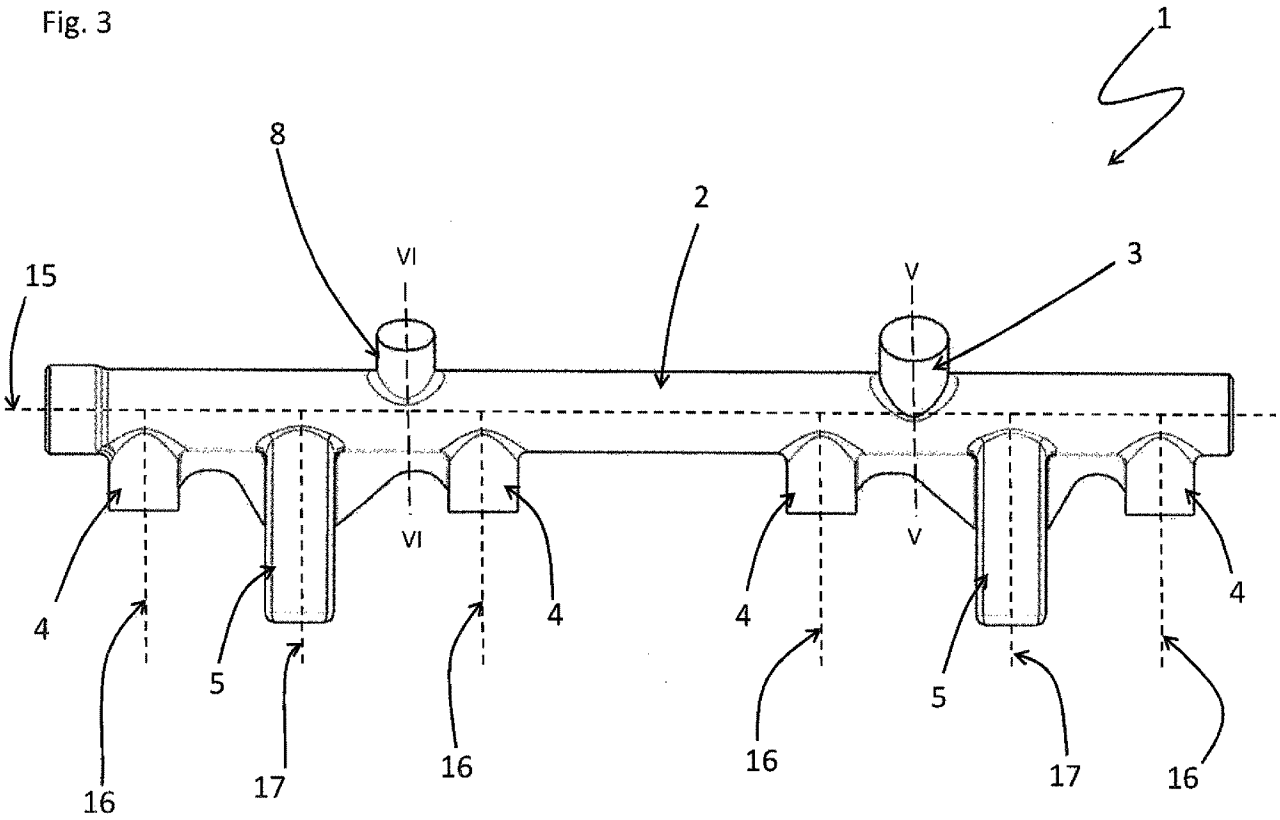
FIG. 3 is a plan view of the fuel rail.

In order to design the installation of the fuel rail 1 as simple as possible and also to reduce stress on the fuel rail 1 during operation, the injector mounts 4 and the support elements 5 are aligned in parallel relation. In other words, the longitudinal axes 16 of the injector mounts 4 and the longitudinal axes 17 of the support elements 5 extend perpendicular to the longitudinal axis 15 of the base body 2, as readily apparent from FIG. 3, and lie in one plane, here the drawing plane. This renders the screw-connection together with the installation of the injectors simple. The forging process is also simplified by this geometric configuration because the injector mounts 4 and the support elements 5 can be arranged in a parting plane of the forging tool.

Figure 4:
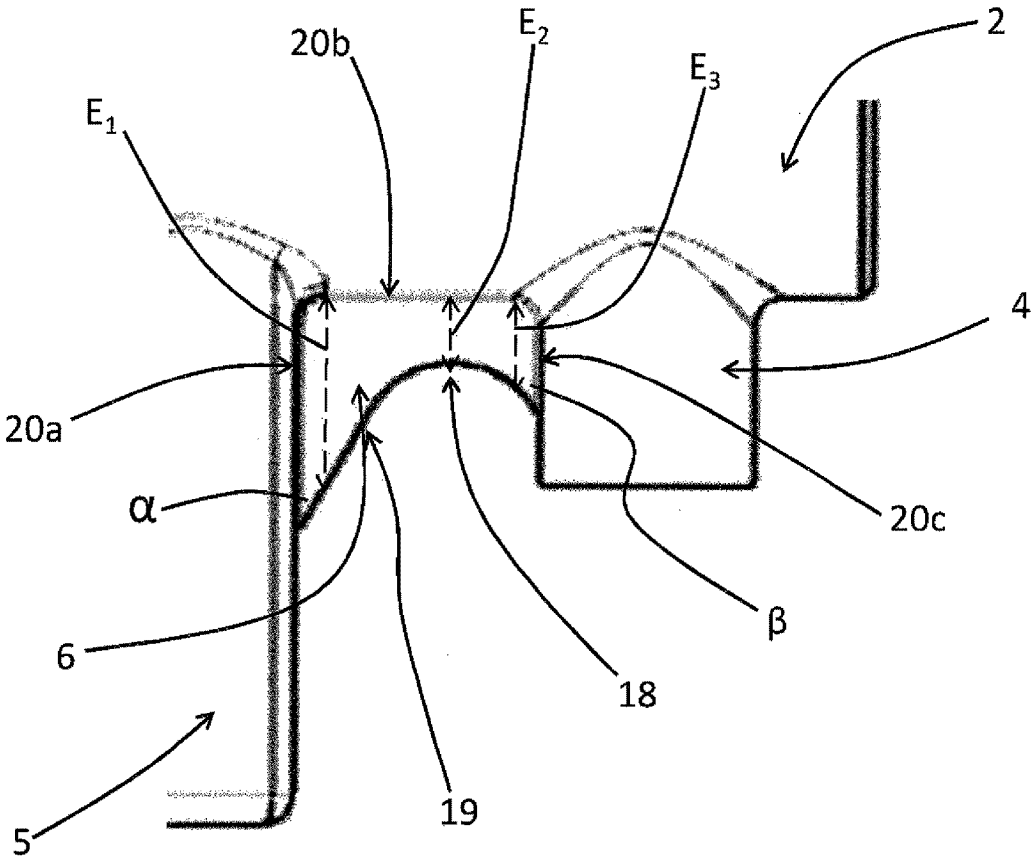
FIG. 4 is an enlarged cutaway view of the fuel rail of FIG. 3.

FIG. 4 shows an enlarged cutaway view of an end of the fuel rail 1 at the first end face 9. The reinforcement member 6 has edges 20*a*, 20*b*, 20*c* which are connected to the base body 2, injector mount 4, and support element 5. The reinforcement member 6 extends perpendicular from the longitudinal axis 15 of the base body 2 radially outwards. The free edge 19 of the reinforcement member 6 has a configuration in the form of an even steady curve. Reference signs $E_1$, $E_2$, $E_3$ defined extents in perpendicular direction to indicate that the course of the free edge 19 is not constant and has a minimum 18 at the extent $E_2$. The minimum 18 is spaced from the injector mount 4 and the support element 5. This means that the extents $E_1$, $E_3$ of the reinforcement member 6, as viewed perpendicular to the longitudinal axis 15 of the base body 2 in proximity to the injector mount 4 and the support element 5, respectively, are greater at all times than the extent $E_2$ in the region of the minimum 18.

This configuration has two objectives. Firstly, the load path between the force entry point at the injector mount 4 and the force exit point at the support element 5 is kept as short as possible to realize a stiffening effect. Secondly, the transitions between the injector mount 4 and the support element 5, on one hand, and the reinforcement member 6, on the other hand is kept as smooth as possible to eliminate any risk of cracks. In other words, there is no sudden transition of reinforcement member 6 to the injector mount 4 and the support element 5. Rather the reinforcement member 6 runs out gradually to the injector mount 4 and the support element 5, respectively, at an angle α as defined between the free edge 19 of the reinforcement member 6 and the connected edge 20*a* adjacent to the support element 5, and at an angle β as defined between the free edge 19 of the reinforcement member 6 and the connected edge 20*c* adjacent to the injector mount 4. Each of the angles α and β. is less than 90°, advantageously less than 60°. Currently preferred is an angle α and β of less than 45°.

The precise configuration of the reinforcement member 6 in terms of the angles α and β and also the radius of the curve, as described by the free edge 19, is dependent on the constructive situation at hand. As is apparent from FIG. 3 for example, the distances between injector mounts 4 and support elements 5 vary, so that the various reinforcement members 6 are not of identical configuration but rather differ in their configuration, since different load paths have to be taken into account. Still, any transition between the reinforcement member 6 and the injector mount 4 or support element 5 is smooth.

FIG. 5 shows a sectional view of the base body 2 of the fuel rail 1 in the region of the inlet 3. The orientation of the inlet 3 relative to the remaining construction of the fuel rail 1 is readily apparent. The longitudinal axis 21 of the inlet 3 and the contact plane 22 of the support element 5 define an angle γ. The contact plane 22 is to be understood as the plane along which the support elements 5 contact a further structure, such as the cylinder head. The angle γ is 60° to 80°, advantageously 65° to 75°. Currently preferred is an angle γ of 70° to 73°.

FIG. 6 shows a sectional view of the base body 2 in a region of the mount 8. The longitudinal axis 24 of the mount 8 and the contact plane 22 of the support element 5 define an angle δ. The angle δ is 70° to 90°, advantageously 75° to 85°. Currently preferred is an angle δ of 79° to 81°.

The fuel rail 1 is secured via the support elements 5 to the cylinder head, for example by a screw connection via the screw holes 25. Corresponding bolts are guided perpendicular to the contact plane 22 through the screw holes 25. The described arrangement of inlet 3 and mount 8 enables access to the screw holes 25 from above, thereby simplifying assembly of the fuel rail 1. At the same time, the inlet 3 for fuel supply and the mount 8 for signal lines of the pressure sensor are still easily accessible in the installation position.

Figure 7:
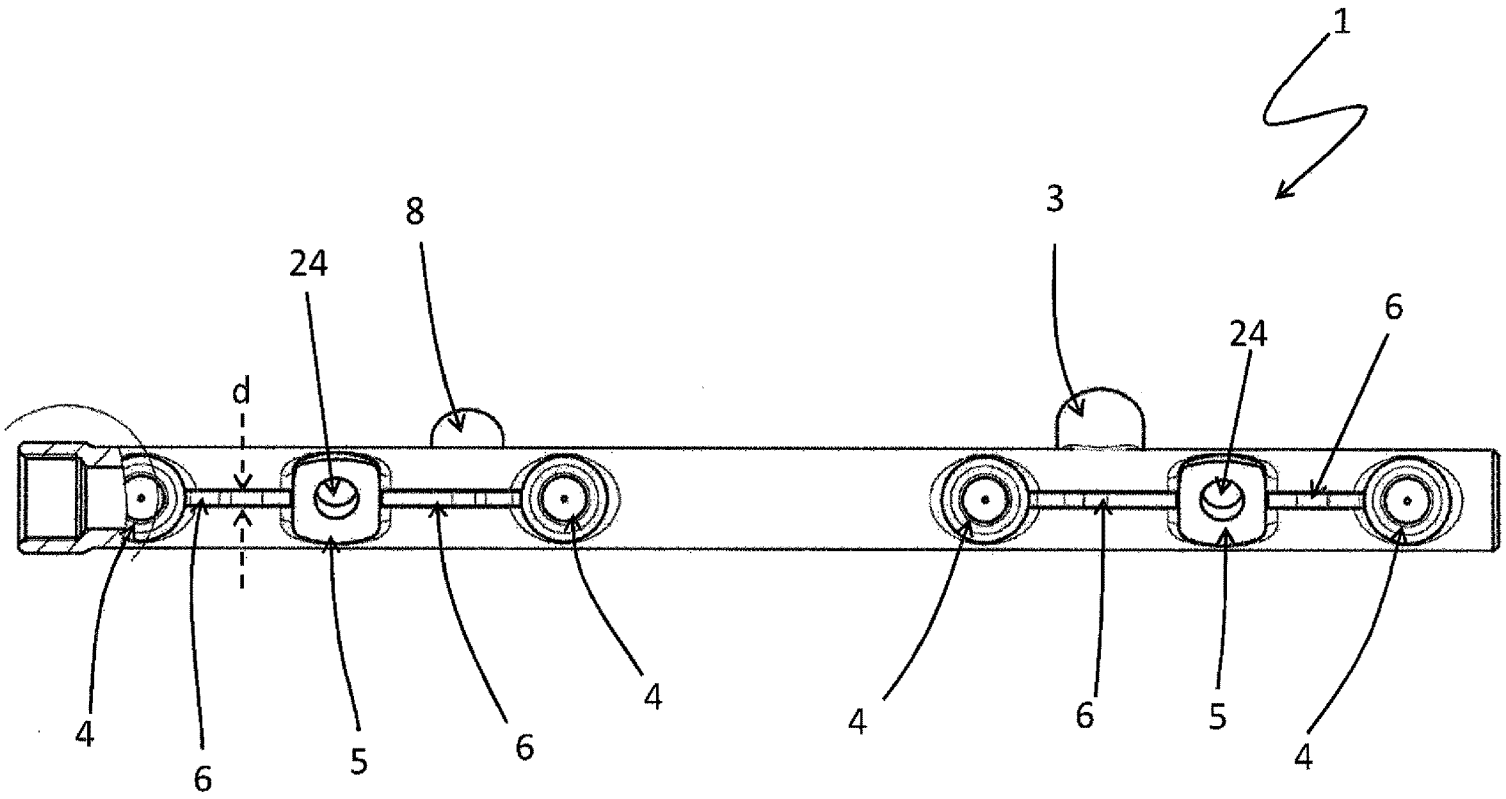
FIG. 7 is a side view of the fuel rail.

FIG. 7 shows a side view of the fuel rail 1, viewed in the direction of the injector mounts 4. As is readily apparent, the reinforcement members 6 have in the non-limiting example, shown in FIG. 7, a uniform thickness d which amounts to 2 to 6 millimeters, advantageously 2.5 to 4.5 millimeters. Currently preferred is a thickness d of 4 millimeters. Also readily apparent is the extent of the reinforcement members 6 perpendicular from the longitudinal axis 15 of the base body 2 radially outwards.

Of course, there is no need for the thickness d to be constant over the entire extent of the reinforcement members 6. The thickness d may vary in the direction of the longitudinal axis 15 of the base body 2 and perpendicular to the longitudinal axis 15. This may further optimize the stiffening effect. Still, the thickness d should amount across the total area of the reinforcement member 6 on average 2 to 6 millimeters, advantageously 2.5 to 4.5 millimeters, or as currently preferred 4 millimeters.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A forged fuel rail, comprising:

a tubular base body;

an inlet formed in one piece on the base body and made of the same material as the base body;

a plurality of injector mounts formed in one piece on the base body and made of a same material as the base body;

a support element formed in one piece on the base body for securement to a further motor vehicle component; and a reinforcement member extending between a corresponding one of the injector mounts and the support element and formed in one piece on the base body and made of a same material as the base body, said reinforcement member having a free first edge shaped to be at a minimum extent in relation to an extent of the reinforcement member perpendicular to a longitudinal axis of the base body and distanced to the corresponding one of the injector mounts and the support element, wherein the reinforcement member has a second edge which is connected to the support element and defines with the free first edge of the reinforcement member a first angle, said reinforcement member having a third edge which is connected to the corresponding one of the injector mounts and defines with the free first edge of the reinforcement member a second angle, each of the first and second angles being less than 90°.

2. The forged fuel rail of claim 1, wherein the corresponding one of the injector mounts and the support element extend in parallel relationship.

3. The forged fuel rail of claim 1, wherein the free first edge of the reinforcement member is shaped in the form of a continuous curve.

4. The forged fuel rail of claim 1, wherein the corresponding one of the injector mounts and the support element are adjacent to one another, with the reinforcement member extending there between.

5. The forged fuel rail of claim 1, wherein the free first edge is shaped to enable a shortest possible load path through the reinforcement member between an entry point of a force at the corresponding one of the injector mounts and an exit point of the force at the support element connected to the corresponding one of the injector mounts by the reinforcement member.

6. The forged fuel rail of claim 1, wherein the reinforcement member has a mean thickness of 2 to 6 millimeters.

7. The forged fuel rail of claim 1, wherein the reinforcement member has a variable thickness.

8. The forged fuel rail of claim 1, wherein the reinforcement member is formed from a flash formed during a forging process.

9. A method of making a fuel rail for a motor vehicle, comprising:

shaping a blank in a forging tool through a forging process into a semi-finished product, thereby forming a flash;

removing the semi-finished product from the forging tool;

subjecting the semi-finished to a machining process;

forming an injector mount and a support element on the semi-finished product such that the flash, when being cut, extends between the injector mount and the support element; and trimming the flash such as to shape a reinforcement member with a free first edge shaped to be at a minimum extent in relation to an extent of the reinforcement member perpendicular to a longitudinal axis of the semi-finished product and distanced to the injector mount and the support element, with a second edge which is connected to the support element and defines with the free first edge of the reinforcement member a first angle, and a third edge which is connected to the injector mount and defines with the free first edge of the reinforcement member a second angle, each of the first and second angles being less than 90°.

10. The method of claim 9, wherein the forging tool is a split forging tool, with the flash being formed in a parting plane of the split forging tool.

11. The method of claim 9, wherein the forging process includes pre-forging and finishing forging.

* * * * *